US008416967B2

(12) United States Patent
Welti

(10) Patent No.: US 8,416,967 B2
(45) Date of Patent: Apr. 9, 2013

(54) BIDIRECTIONAL, VARIABLE-IMPEDANCE INSTRUMENT-LEVEL TO PROFESSIONAL-LEVEL AUDIO INTERFACE WITH SIGNAL SPLITTERS AND BALANCED DC POWER

(76) Inventor: Alexander George Welti, Nashville, TN (US)

( * ) Notice: Subject to any disclaimer, the term of this patent is extended or adjusted under 35 U.S.C. 154(b) by 886 days.

(21) Appl. No.: 12/380,175

(22) Filed: Feb. 24, 2009

(65) Prior Publication Data

US 2009/0323988 A1 Dec. 31, 2009

Related U.S. Application Data

(60) Provisional application No. 61/066,998, filed on Feb. 25, 2008.

(51) Int. Cl.
*G10H 1/00* (2006.01)

(52) U.S. Cl.
USPC ..... 381/118

(58) Field of Classification Search ..... 381/118
See application file for complete search history.

(56) References Cited

U.S. PATENT DOCUMENTS

| | | | | |
|---|---|---|---|---|
| 4,345,502 | A * | 8/1982 | Jahns | 84/723 |
| 4,580,111 | A * | 4/1986 | Swanson | 332/152 |
| 5,343,159 | A | 8/1994 | Butler | |
| 5,506,532 | A * | 4/1996 | Milazzo | 327/175 |
| 5,706,354 | A * | 1/1998 | Stroehlein | 381/94.1 |
| 5,789,689 | A * | 8/1998 | Doidic et al. | 84/603 |
| 6,005,950 | A | 12/1999 | Cuniberti | |
| 6,792,120 | B1 | 9/2004 | Szenics | |
| 7,089,333 | B2 * | 8/2006 | Marinescu et al. | 709/248 |
| 7,996,588 | B2 * | 8/2011 | Subbiah et al. | 710/72 |
| 2004/0044804 | A1 * | 3/2004 | Mac Farlane | 710/1 |
| 2004/0144241 | A1 * | 7/2004 | Juskiewicz et al. | 84/723 |
| 2006/0159291 | A1 * | 7/2006 | Fliegler et al. | 381/118 |
| 2007/0139121 | A1 * | 6/2007 | Baldwin et al. | 330/297 |
| 2008/0044041 | A1 * | 2/2008 | Tucker et al. | 381/120 |
| 2008/0130331 | A1 * | 6/2008 | Baldwin et al. | 363/80 |
| 2008/0173164 | A1 * | 7/2008 | Francis et al. | 84/721 |
| 2009/0003619 | A1 * | 1/2009 | Solow | 381/77 |

OTHER PUBLICATIONS http://en.wikipedia.org/wiki/Re-amp An article discussing some methods mentioned in "Background of Invention."
http://reamp.com/ Utilizes patent #6,005,950.
http://www.mil-media.com/td-1.html Appears to utilize patent #6,005,950.
http://www.radialeng.com/di-xamp.htm Appears to utilize patent #6,005,950.
http://www.littlelabs.com/redeye.html Transformer based passive direct box.

* cited by examiner

*Primary Examiner* — Robert J Hoffberg
*Assistant Examiner* — Igwe U Anya
(74) *Attorney, Agent, or Firm* — Miller & Martin PLLC; Douglas T. Johnson

(57) ABSTRACT

An audio frequency variable-impedance instrument-level to professional-level audio interface with balanced DC power, comprising a unique arrangement of electronic elements, consisting of the musical instrument-level signal splitter with professional-level audio output interface 10, the professional-level signal splitter to instrument-level interface 12 and the power supply with regulation, innovative new DC balancing and power distribution 14. The innovation of balanced DC power effectively cancels the unwanted power supply noise on professional audio electronics giving greatly improved distortion and lower noise specifications over previous designs.

15 Claims, 7 Drawing Sheets

BIDIRECTIONAL, VARIABLE-IMPEDANCE INSTRUMENT-LEVEL TO PROFESSIONAL-LEVEL AUDIO INTERFACE WITH SIGNAL SPLITTERS AND BALANCED DC POWER

CROSS-REFERENCE TO RELATED APPLICATIONS

This application claims the benefit of provisional patent application Ser. No. 61/066,998 filed 2008 Feb. 25 by the present inventor.

FEDERALLY SPONSORED RESEARCH

Not Applicable

SEQUENCE LISTING OR PROGRAM

Not Applicable

BACKGROUND OF THE INVENTION

1. Field of Invention

This invention generally relates to professional audio production and electronic musical instruments, specifically to the interfacing of electronic audio signals between what is commonly known among audio engineers as instrument-level audio devices and professional-level audio devices; relating to the connection between various electronic musical instruments or devices to and from various professional audio signal processing or recording devices.

2. Prior Art

The worlds of the professional audio engineer and the professional musician come together in the recording studio and also in the performance venue or on-stage. However, professional audio equipment designed for the audio engineer uses what is known in the industry as professional-level interfacing which came from the early telephone industry standards for audio electronics, whereas instrument-level audio equipment is designed to use what is known to the audio engineer as instrument-level interfacing which evolved separately around the high impedance pick-ups and amplifiers used for many electric musical instruments.

The telephone industry 0 dBm reference for measuring audio signal power levels was adopted by the early audio engineer. Many modern professional-level interfaces are primarily concerned with voltage level and not power level; to delineate this, the professional audio industry also uses 0 dBu (a variation of 0 dBm). Professional audio signal levels are generally between 0 dBu to positive 20 dBu, whereas instrument audio signal levels are generally between negative 20 dBu and 0 dBu. Also, professional audio interfaces use lower impedances which are better for connections at a distance and are less susceptible to interference and pick-up of undesirable noise.

Electric musical instruments use a transducer, such as a magnetic pick-up device, mounted on or inside a musical instrument. The nature of these pick-up devices requires that they have higher output impedances in order to be sensitive enough to produce a useable electronic voltage signal. However, when these higher impedance pick-up devices are connected directly to lower impedance professional audio equipment, the higher output impedance forms a voltage-divider with the lower input impedance. This causes loss and degradation of the original signal. Therefore, these electronic pick-up devices require specialized high input impedance preamplifiers which minimize the voltage-divider effect in order to preserve the original audio signal; thus instrument-level audio equipment evolved to accommodate lower-level, higher-impedance signals.

Interfacing these instrument-level signals with professional audio devices has been a challenge to both the audio engineer and professional musician. Oftentimes the musician's performance is influenced and inspired by the sound and volume of their audio processing devices. For example, the volume of the musician's amplifier may be used to create sustain in the musician's performance by intentionally generating positive-feedback. For the audio engineer, this means that the original signal from the pick-up device must be connected through the musician's audio processing devices. This is essential to the musician's performance but at odds with the goal of the audio engineer which is to capture the purest audio signal directly from the pick-up without adding the characteristics of the musician's audio processing devices. This is due to the fact that the audio engineer may wish to experiment with a variety of audio processing devices and may choose not to employ the musician's audio processing devices. A well known compromise has been to employ a signal splitting device known as a direct-box which can be used to split the signal from the instrument to allow a part of the original signal to be sent to the musician's audio processing devices and a part of the original signal to be sent to the audio engineer. However, it has been difficult to split the original signal without affecting its quality. Musicians and audio engineers both complain that signal splitting devices have undesirable side-effects and disadvantages, for example:

(a) They are known to introduce some unacceptable tonal-coloration. The ideal signal splitting device should preserve the original audio signal in the purest form and not add any hint of its own character to the signal.

(b) They add some unwanted noise. The ideal signal splitting device should add as little of its own noise as possible. Once noise is added to the original signal it is difficult to remove without also removing some of the desired signal.

(c) They introduce some signal distortion. The ideal signal splitting device should not distort the original signal unnecessarily.

An improved signal splitting device would need to have a very high input impedance to interface with the original signal from the pick-up device. The signal splitting device would need to preserve the lower-level higher-impedance signal for interfacing with the musician's instrument-level audio processing devices. Additionally, the signal splitting device would need to boost the audio level and lower the signal impedance to interface with professional-level audio processing devices.

Also, a musician may want to use a professional-level audio device in-line with their instrument-level audio processing devices. To do this, the musician would need an interface to insert the professional-level audio devices into his instrument-level signal chain. Previously, the musician would start with an interface device such as the discussed direct-box to raise the level and lower the impedance of the audio signal coming from his instrument-level audio processing device for interfacing to a professional-level audio device. After processing the signal through the professional-level audio device the musician would then need a reverse interface device to lower the level and raise the impedance of the audio signal returning from the professional-level audio processing device for interfacing to the remainder of his instrument-level audio devices.

Also, an audio engineer may want to re-process a professional-level audio signal through instrument-level audio processing devices to achieve a particular effect. To do this, the audio engineer would need an interface to insert the instrument-level audio processing devices into his professional-level audio signal chain. Previously, the audio engineer would start with a reverse interface device to lower the level and raise the impedance of the professional-level audio signal for interfacing to the instrument-level audio processing devices. Then the audio engineer would use an interface device such as the previously discussed direct-box to raise the level and lower the impedance of the audio signal returning from the instrument-level audio processing device for interfacing to his professional-level audio devices. In some instances, it may be desirable to intentionally mismatch input and output impedances to achieve a desired effect or to simulate a tailored vintage sound, thus a way to make the impedances variable would be needed.

Previously, examples of devices that could be employed to act as a reverse interface device for the purpose of interfacing a signal coming from a professional-level audio device to an instrument-level device as well as similar devices which employ the same principles, have several limitations and disadvantages, for example:

(a) These devices generally use a transformer, vacuum tube or FET means, all of which are known to introduce some undesired tonal-coloration. The ideal reverse interface device should preserve the original audio signal in the purest form and not add any hint of its own character to the signal.

(b) Also, because these devices use a transformer, vacuum tube or FET means, they introduce some undesirable noise and signal distortion. The ideal reverse interface device should not distort the original signal unnecessarily.

(c) A well known re-amplification device employs a potentiometer which simultaneously adjusts the output level and the output impedance which makes it difficult (in some cases impossible) to match the level and the impedance as desired. The ideal reverse interface should allow level and impedance to be set independent of each other.

(d) A well known re-amplification device which is passive must be physically located near the instrument-level audio devices; it cannot be remotely located in a convenient location such as in an equipment rack inside a recording control room.

(e) Because a well known re-amplification device which is passive uses no power it cannot provide active signal metering.

(f) Also, because a well known re-amplification device which is passive uses no power, it cannot provide illumination which is desired by the professional audio engineer who often works in a darkened environment, such as a theater for example.

3. Objects and Advantages

Accordingly, I have invented an improved bidirectional, variable-impedance instrument-level to professional-level audio interface with signal splitters and balanced DC power with the following objects and advantages:

Extremely high audio quality. This device adds virtually no undesirable signal-coloration, distortion or noise. This device has a new novel circuit design for its internal power conditioning which produces a quality of specifications not achieved in previous interface devices.

An interface device with a signal splitting feature having variable input impedance for interfacing with instrument-level pick-up devices or instrument-level audio processing devices. The signal splitting device provides five outputs. Two outputs which simply buffer the original signal. A third and fourth output which provide variable output level and variable output impedance. A fifth output which provides a variable output level and professional low impedance balanced interface.

A reverse interface device with a signal splitting feature having a low impedance input for interfacing with professional-level audio equipment. The signal splitting device provides two outputs. Both outputs provide variable output level and variable output impedance.

Other Objects and Advantages are:

Provision of variable-impedance inputs and outputs for flexible interfacing to a variety of common audio equipment.

Provision of a reconfigurable signal ground reference to help solve common grounding problems.

Provision of signal level indication to help ensure levels are set within an acceptable range.

Provision of illuminated rear connector labels to make connections visible in poor lighting situations common in recording studios and back-stage environments.

Further objects and advantages of my invention will become apparent from a consideration of the drawings and ensuing description.

SUMMARY

This BIDIRECTIONAL, VARIABLE-IMPEDANCE INSTRUMENT-LEVEL TO PROFESSIONAL-LEVEL AUDIO INTERFACE WITH SIGNAL SPLITTERS AND BALANCED DC POWER comprises a unique arrangement of electronic elements with very clean DC power, high audio signal quality, variable input and output impedance, low power consumption, flexible ground referencing and versatility when interfacing between instrument-level audio devices and professional-level audio devices.

DRAWINGS—FIGURES

DRAWINGS—REFERENCE NUMERALS

Figure 1:
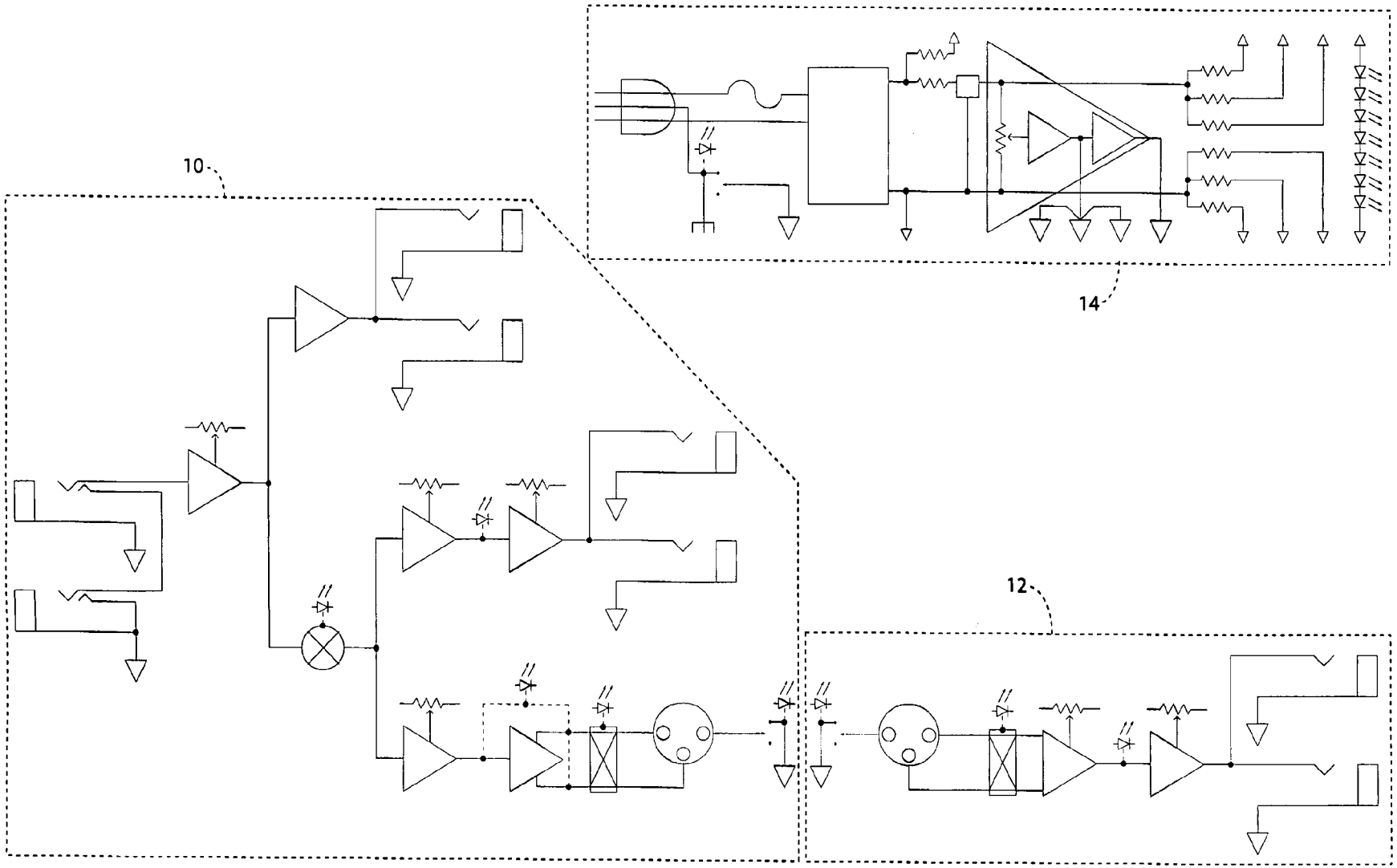
FIG. 1 is an overall basic block diagram of the invention.

10 Instrument-level signal splitter with professional-level audio output interface

12 Professional-level signal splitter to instrument-level output interface

14 Power supply with regulation, DC balancing and distribution
16 Rear panel instrument-level input
18 Front panel instrument-level input
20 Input amp with variable input impedance
22 Pre-mute, split buffered instrument-level output amp
24 Front panel pre-mute, split buffered instrument-level output
26 Rear panel pre-mute, split buffered instrument-level output
28 Mute switch
30 Mute indicator
32 Post-mute, split boosted instrument-level output amp
36 Post-mute, split boosted instrument-level signal indicator
38 Variable output impedance circuit
42 Front panel post-mute, split boosted instrument-level output
44 Rear panel post-mute, split boosted instrument-level output
46 Post-mute, split boosted professional-level audio output amp
50 Signal balancing output amp
52 Professional balanced output signal indicator
54 Output polarity switch
56 Output polarity indicator
58 Male XLR rear panel professional-level output

DRAWINGS—REFERENCE NUMERALS (CONTINUED)

60 Male XLR ground-lift switch
62 Male XLR ground-lift indicator
64 Female XLR rear panel professional-level input
66 Female XLR ground-lift switch with indicator
68 Input polarity switch with indicator
72 Balanced input amp
74 Input signal indicator
76 Variable output impedance circuit
78 Front panel instrument-level output
80 Rear panel instrument-level output
82 AC power connection with safety ground
84 Chassis ground connection
86 System ground
88 System ground-lift switch with indicator
90 AC fuse
92 AC to DC commercial power supply with floating output
94 48VDC positive output
96 $+V_{led}$ power with fusistor for switch indicators and rear panel illumination
94 48VDC common output and $-V_{led}$ power
100 36VDC power regulator with fusistor
102 DC power balancing circuit
104 System star ground reference point
106 Instrument-level signal splitter and professional audio interface star ground point
108 Professional-level signal splitter to instrument-level interface star ground point
110 Signal level indicators star ground point

DRAWINGS—REFERENCE NUMERALS (CONTINUED)

112 Positive 18VDC with respect to system ground
114 Negative 18VDC with respect to system ground
116 +Va positive 18VDC feed for instrument-level signal splitter and professional audio interface
118 −Va negative 18VDC feed for instrument-level signal splitter and professional audio interface
120 +Vb positive 18VDC feed for professional-level signal splitter to instrument-level interface
122 −Vb negative 18VDC feed for professional-level signal splitter to instrument-level interface
124 +Vc positive 18VDC feed for signal level indicators
126 −Vc negative 18VDC feed for signal level indicators
128 Network of light emitting devices for rear panel illumination
130 Electronic musical instrument
132 Electronic chromatic tuner
134 Electronic musical instrument amplifier
136 Professional audio recording console
138 Professional audio recording device
140 Microphone
142 Guitar FX pedal
144 Professional audio signal processing device

DETAILED DESCRIPTION—PREFERRED EMBODIMENT—FIGS. 1, 2, 3, 4

A preferred embodiment of the bidirectional, variable-impedance instrument-level to professional-level audio interface with signal splitters and balanced DC power is illustrated in block diagram form in FIG. 1. The invention has three main sections. A musical instrument-level signal splitter with professional-level audio output interface section 10. A professional-level signal splitter to instrument-level interface section 12. A power supply with regulation, innovative new DC balancing and power distribution section 14.

Figure 2:
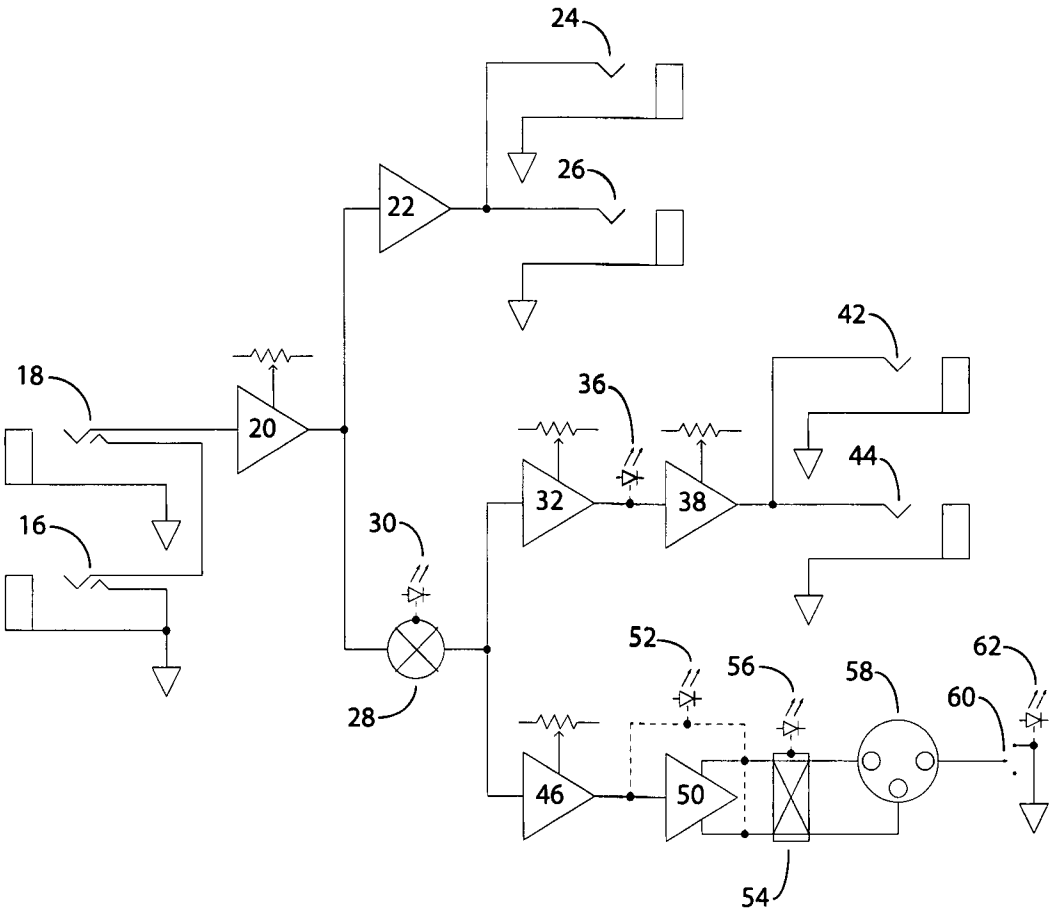
FIG. 2 is a diagram of an instrument-level signal splitter with professional-level audio output interface.

With reference to FIG. 2, a instrument-level signal splitter with professional-level audio output interface accepts a instrument-level input through a rear panel instrument-level input connection 16 or a front panel instrument-level input connection 18. The input signal is presented to a buffer device with variable input impedance 20. This input amp with variable input impedance 20 has been designed to vary the input impedance from ten thousand ohms to over ten million ohms. The signal then splits into a first and a second signal path. The first signal path is presented to an instrument-level output amp 22 and the second signal path is presented to a mute switch 28. The output amp 22 feeds a front panel instrument-level output connection 24 and a rear panel instrument-level output connection 26. The output connectors 24 and 26 are not affected by operation of the mute switch 28 and are therefore pre-mute outputs. The mute switch 28 alternately connects and disconnects the second signal path to the remainder of this circuit. A mute indicator 30 is designed to illuminate when the second signal path is disconnected. Following the mute switch 28 the second signal path then splits into a third and a fourth signal path. The third signal path is presented to a boosted instrument-level output amp 32 and the fourth signal path is presented to a boosted professional-level output amp 46. The boosted instrument-level output amp 32 is designed to boost the signal to adjust the output gain between 0 dBu and 30 dBu. The boosted instrument-level output amp 32 is followed by a novel signal indicator 36 and a variable output impedance circuit 38. The signal indicator 36 is designed with a means to indicate various conditions. In a condition where there is no signal present, the indicator 36 is completely off. In a condition where there is a low signal level present, the indicator 36 displays a low indication. In a condition where there is an optimal signal level present, the indicator 36 displays an optimal indication. In a condition where there is an excessively high signal level present, the indicator 36 displays an excessive indication. The variable output impedance circuit 38 is designed to vary output impedance from fifty ohms to one hundred thousand ohms. The variable output impedance circuit 38 feeds a front panel instrument-level output connection 42 and a rear panel instrument-level output connection 44. The output connectors 42 and 44 are affected by operation of the mute switch 28 and are therefore post-mute outputs. The boosted professional-level output amp 46 is designed to boost the signal to adjust the output gain between 0 dBu and 30 dBu. The boosted professional-level output amp 46 is followed by a feed to a signal indicator 52 and a signal balancing output amp 50. The signal balancing output amp 50 is followed by two additional feeds to the signal indicator 52 and a polarity switch 54. The signal indicator 52 is designed to operate in the same fashion as the signal indicator 36 described previously. The polarity switch 54 reverses polarity of the balanced signal presented to an output connection 58. A polarity indicator 56 is designed to indicate whether signal polarity is normal or whether signal polarity is reversed. A ground-lift switch 60 alternately connects and disconnects ground from the output connector 58. A ground-lift indicator 62 is designed to indicate whether ground is connected or whether ground is disconnected.

Figure 3:
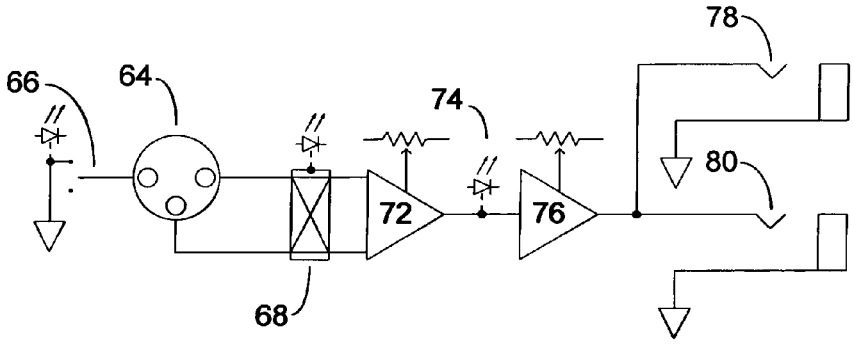
FIG. 3 is a diagram of a professional-level signal splitter to instrument-level interface, which is a reverse of the interface shown in FIG. 2.

With reference to FIG. 3, a professional-level signal splitter to instrument-level interface accepts a professional-level audio signal through a balanced input connection 64. A ground-lift switch with indicator 66 alternately connects and disconnects ground from the input connector 64. A polarity switch with indicator 68 reverses polarity of the balanced signal accepted from the input connection 64. Following the polarity switch 68 the signal feeds a balanced input amp 72. The balanced input amp 72 is designed to attenuate the signal or adjust the input level between 0 dBu and −36 dBu. The signal is then fed to a signal indicator 74 and a variable output impedance circuit 76. The signal indicator 74 is designed to operate in the same fashion as the signal indicator 36 described previously. The variable output impedance circuit 76 is designed to vary output impedance from fifty ohms to one hundred thousand ohms. The variable output impedance circuit 76 feeds a front panel instrument-level output connection 78 and a rear panel instrument-level output connection 80.

Figure 4:
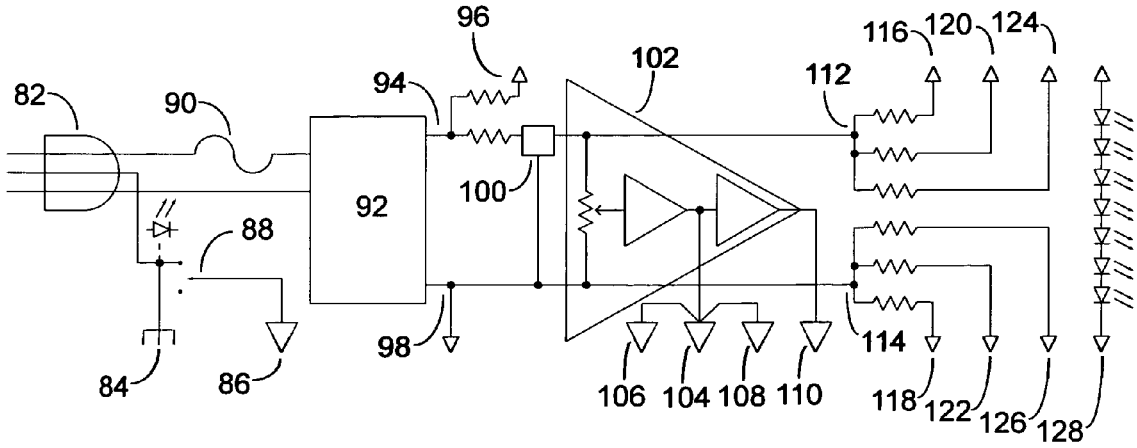
FIG. 4 is a diagram of a power supply with regulation, DC balancing and distribution.

With reference to FIG. 4, a power supply with regulation, dc balancing and distribution section is supplied with commercial AC power through a three conductor AC power connection with a safety ground 82. The safety ground is always attached to a chassis ground connection 84. A ground reference point for the invention is a system ground 86. A system ground-lift switch with indicator 88 alternately connects and disconnects the system ground 86 from the chassis ground 84. The AC power is connected to a safety fuse 90 and then to a commercially available power supply 92. The power supply 92 accepts international AC voltages between 90VAC and 240VAC with frequencies of 50 Hz or 60 Hz. The power supply 92 produces a floating 48VDC positive output 94 when referenced to a floating 48VDC common output 98. The 48VDC positive output 94 is connected through a fusistor to $+V_{led}$ 96 to provide unregulated power to the six switch indicators 30, 56, 60, 66, 68, 84 and also a network of light emitting devices 128, which provide novel illumination to the rear panel connectors. $+V_{led}$ 96 returns to the 48VDC common output $-V_{led}$ 98. The 48VDC positive output 94 is also connected through a fusistor to a 36VDC power regulator 100 to provide regulated power to a novel DC power balancing circuit 102. The DC power balancing circuit 102 produces a system star ground reference point 104 in such a way that divides the output of regulator 100 into a positive 18VDC output 112 when referenced to the system star ground reference point 104 and a negative 18VDC output 114 when referenced to the system star ground reference point 104; and also keeps these voltages balanced.

This balancing action is a novel approach which substantially improves power supply noise specifications, and which in-turn substantially improves the audio specifications of the invention. The old way of powering the circuit would have started with two separate positive and negative 18VDC power supplies and therefore two asynchronous sources of noise. My novel approach to this power supply design uses just one 48VDC power supply regulated down to 36VDC, therefore, only a single source of noise. Dividing and balancing the 36VDC creates the necessary positive and negative 18VDC power supplies, each with half the original noise. Also, noise on the negative 18VDC is synchronous to the noise on the positive 18VDC but with the opposite polarity. Therefore the noise completely cancels itself in the audio circuit. Test results on the invention showed at least an 18 dBu improvement in lowering the noise floor and markedly better distortion specifications compared to the conventional design. Additionally, this novel approach of dividing and balancing a DC power supply to cancel noise is not limited to just positive and negative 18VDC power supplies, but can be applied to create any DC voltage desired and incorporated to improve the specifications of pre-existing as well as future audio electronic designs.

The system star ground reference point 104 is connected directly to an instrument-level signal splitter and professional audio interface ground reference point 106. The system star ground reference point 104 is also connected directly to a professional-level signal splitter to instrument-level interface ground reference point 108. The DC power balancing circuit 102 also produces a buffered ground reference point 110 which is a separate ground reference for the three signal indicators 36, 52 and 74. The positive 18VDC output 112 and the negative 18VDC output 114 are distributed through fusistors to the audio circuits. A +Va positive 18VDC feed 116 and a −Va negative 18VDC feed 118 provide power for the musical instrument-level signal splitter with professional-level audio output interface section 10. A +Vb positive 18VDC feed 120 and a −Vb negative 18VDC feed 122 provide power for the professional-level signal splitter to instrument-level interface section 12. A +Vc positive 18VDC feed 124 and a −Vc negative 18VDC feed 126 provide power for the three signal indicators 36, 52 and 74. This use of the system star ground reference point 104 and power distribution through the feeds 116, 118, 120, 122, 124 and 126 works to minimize cross-talk noise and distortion between the three main sections 10, 12 and 14.

OPERATION—PREFERRED EMBODIMENT—FIGS. 5, 6, 7, 8

Figure 5:
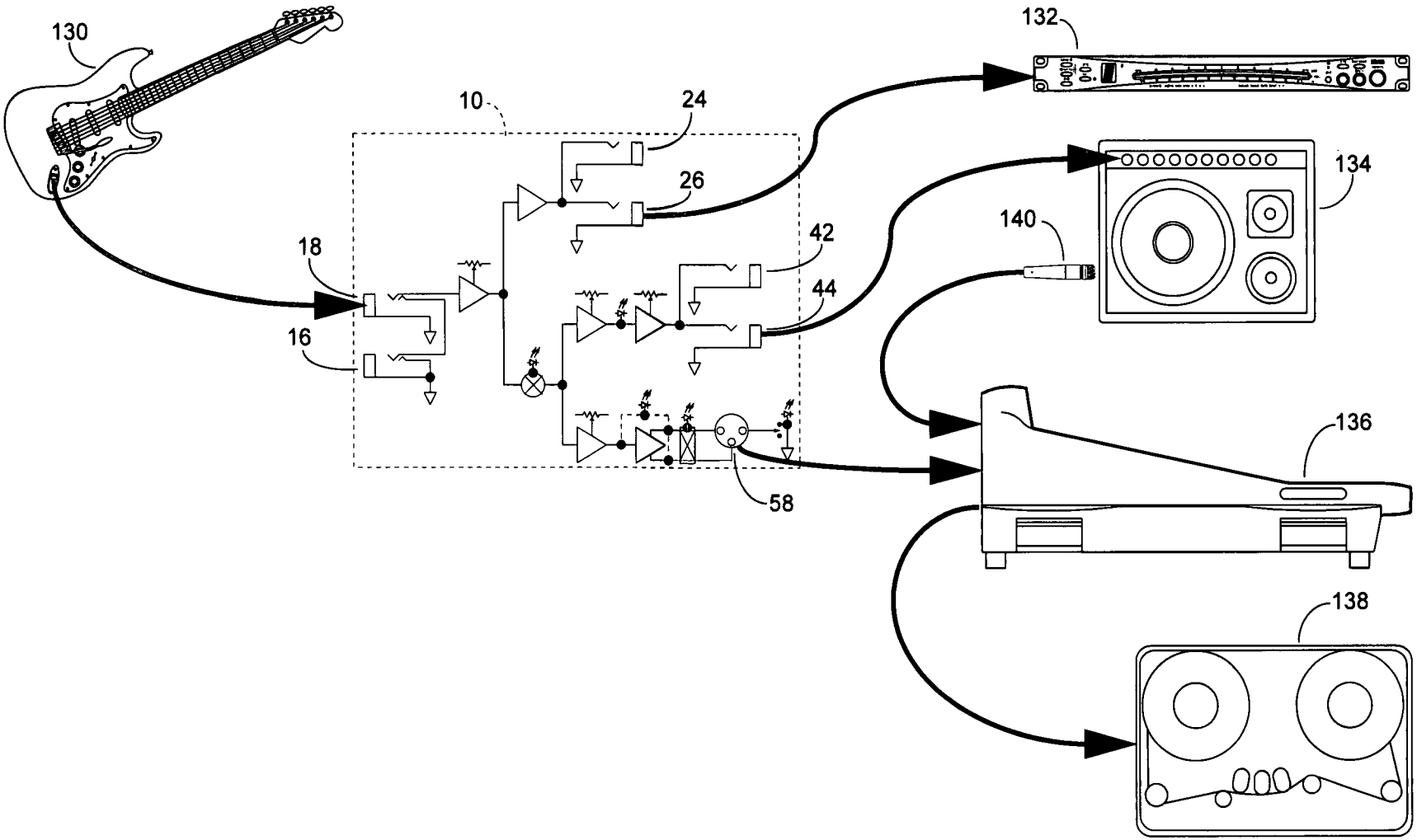
FIG. 5 is a typical connection diagram for a recording session.

With reference to FIG. 5, a typical connection diagram for a recording session is shown. An electric musical instrument such as an electric guitar 130 is connected to either instrument-level input 16 or 18. Various instrument-level devices may be connected to any of the instrument-level outputs 24, 26, 42, and 44. For example a chromatic tuner 132 may be connected to either of the pre-mute outputs 24 or 26 and an electric guitar amplifier 134 may be connected to either of the post-mute outputs 42 or 44 such that the user may mute the sound while the instrument is being tuned. A professional audio recording system such as an audio recording console 136 and a recording device 138 would be connected to the professional-level audio output 58.

This way the original audio signal of the instrument may be recorded in its purest form without adding the sound characteristics of the musician's choice of amplifier, however, the musician can hear the sound of his or her preferred amplifier to help inspire their performance. The audio engineer would set the various impedance, level, polarity and ground-lift controls of the invention to tailor the recording as desired. Optionally, an additional track of the musician's preferred amplifier may be recorded using a device such as microphone 140 so that the audio engineer may capture both the original pure signal as well as the musician's tailored sound if desired.

Figure 6:
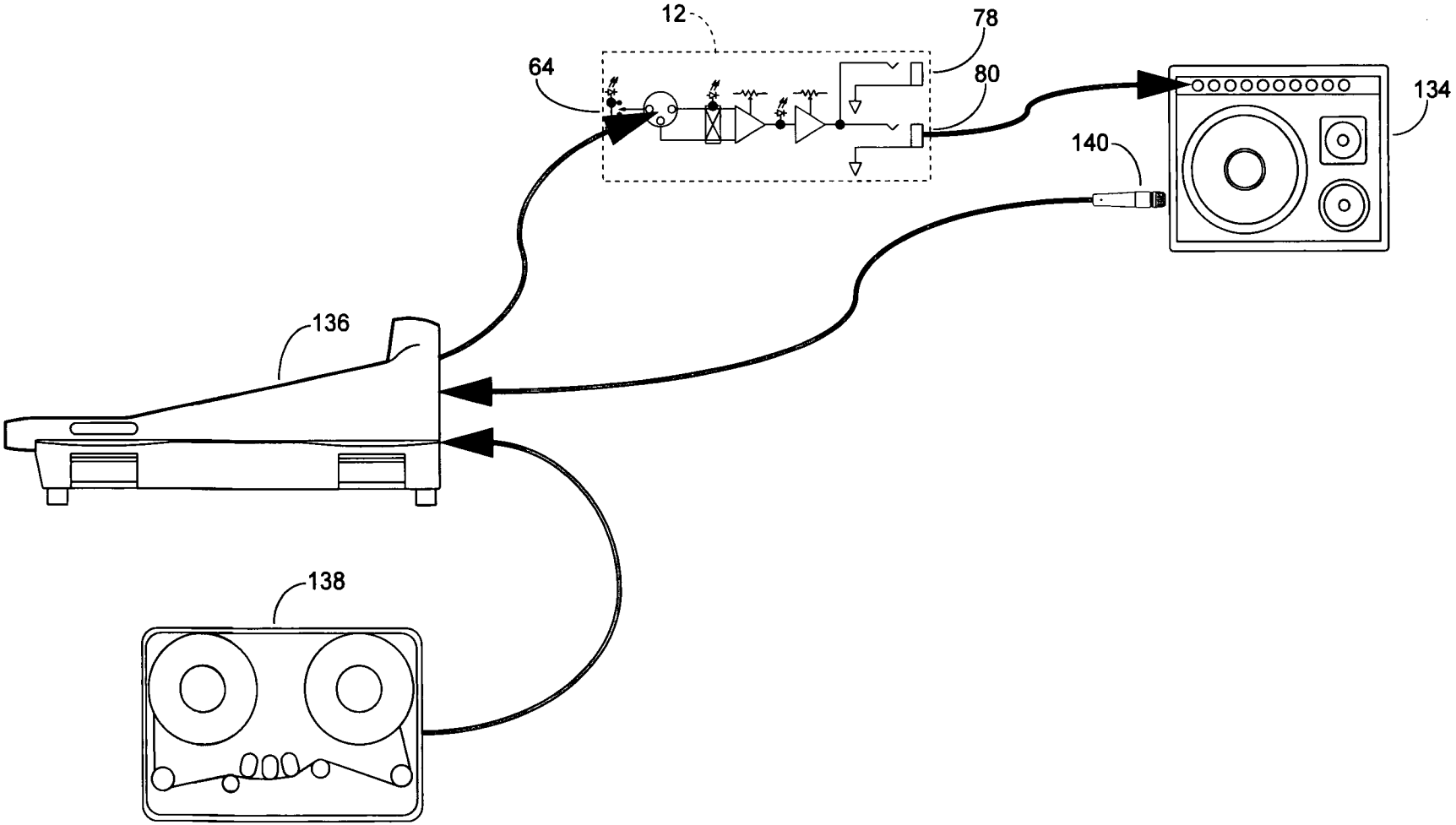
FIG. 6 is a typical connection diagram for a re-processing session.

With reference to FIG. 6, a typical connection diagram for a re-amping session is shown. Having previously recorded a pure signal as shown by the example of FIG. 5 the audio engineer desiring to create a tailored sound would connect the professional audio recording device 138 through recording console 136 to the professional-level audio input 64. Either of the instrument-level outputs 78 or 80 would be connected to various instrument-level devices such as guitar amplifier 134.

The audio engineer then plays-back the original signal to the amplifier and tailors the sound using the amplifier's controls. The audio engineer would also set the various impedance, level, polarity and ground-lift controls of the invention to tailor the sound as desired. The preferred sound may then be captured using a device such as the microphone 140 and be re-recorded or mixed together with the original signal. By repeating this process the audio engineer may try-out a variety of different amplifiers or other instrument-level devices to find a preferred sound or build upon the original sound in a variety of ways. This can all be done using the recording; not requiring the musician to repeat his or her performance over and over.

Figure 7:
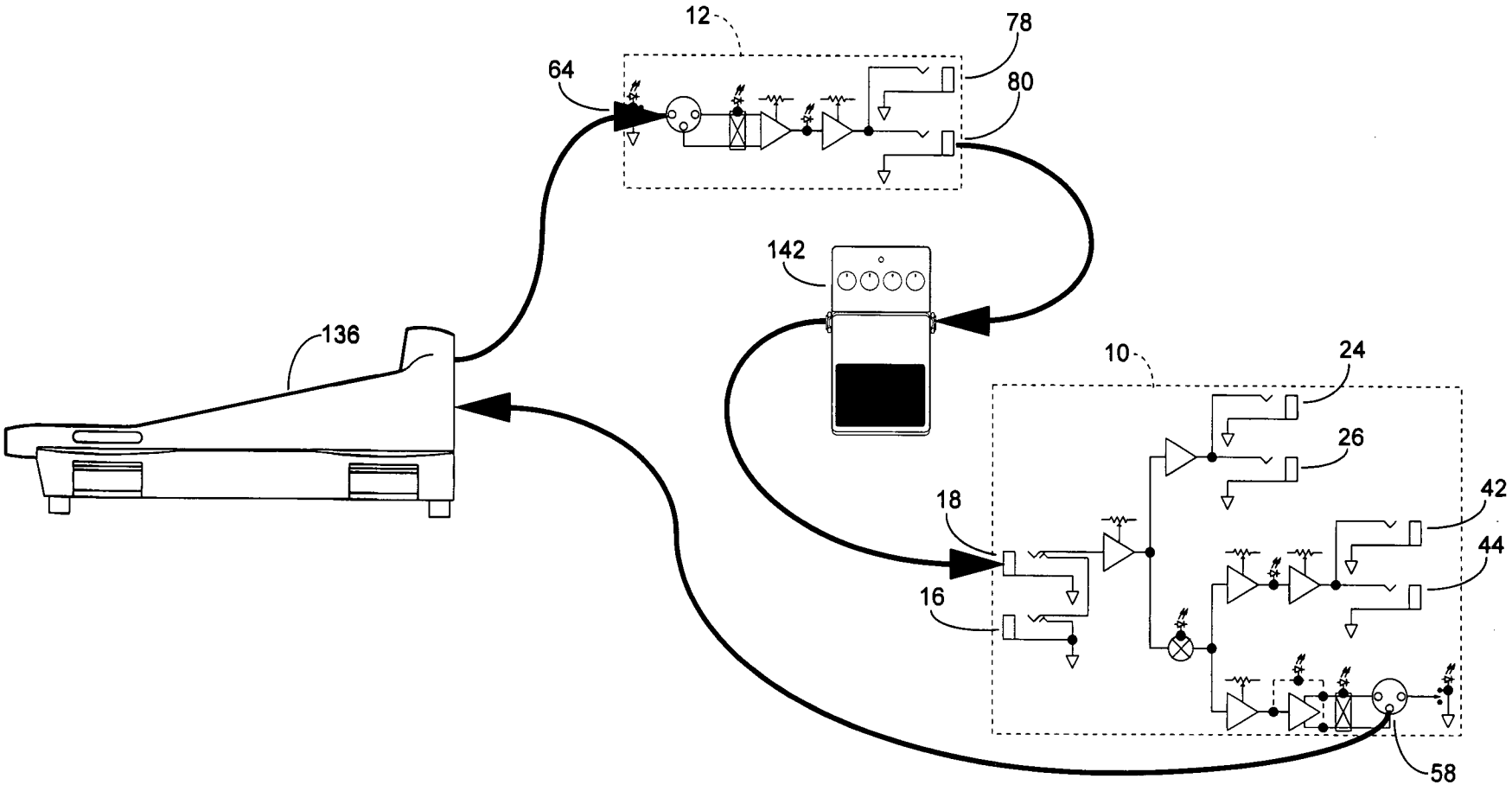
FIG. 7 is a typical connection diagram for inserting instrument-level audio signal processing equipment into a professional-level audio signal chain.

With reference to FIG. 7, a typical connection diagram for inserting instrument-level audio signal processing equipment in a professional-level audio signal chain is shown. In some instances, a creative audio engineer may desire to use an instrument-level effects device in a professional audio signal chain. The audio engineer would connect the professional audio console 136 to the professional-level audio input 64. Either of the instrument-level outputs 78 or 80 would be connected to the input of various instrument-level devices such as a guitar FX pedal 142. The output of the FX pedal would then be connected to either instrument-level input 16 or 18. The professional audio console 136 would be connected to the professional-level audio output 58. In this way any professional audio signal could be processed by any instrument-level device. The audio engineer would set the various impedance, level, polarity and ground-lift controls of the invention to tailor the sound as desired.

Figure 8:
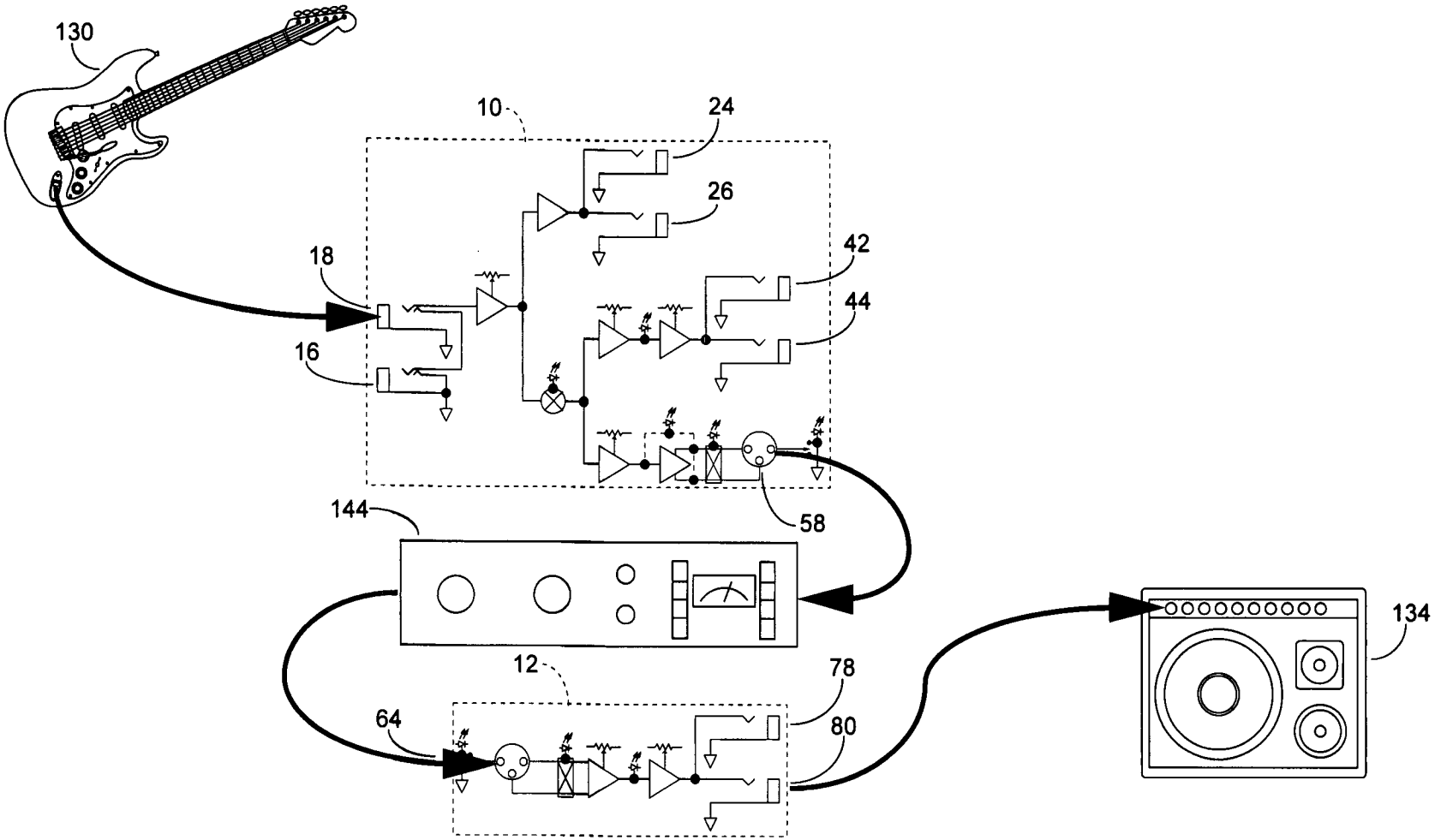
FIG. 8 is a typical connection diagram for inserting professional-level audio signal processing equipment into an instrument-level audio signal chain.

With reference to FIG. 8, a typical connection diagram for inserting professional-level audio signal processing equipment in an instrument-level audio signal chain is shown. In some instances, a creative musician may desire to use a professional-level effects device in an instrument-level audio signal chain. An electric musical instrument such as an electric guitar 130 is connected to either instrument-level input 16 or 18. A professional audio processing device such as a compressor device 136 would be connected to the professional-level audio output 58. The output of the compressor device would then be connected to professional-level audio input 64. Either of the instrument-level outputs 78 or 80 would be connected to the input of various instrument-level devices such as the guitar amplifier 134. In this way any instrument-level audio signal could be processed by any professional-level device. The musician would set the various impedance, level, polarity and ground-lift controls of the invention to tailor the sound as desired.

CONCLUSION, RAMIFICATIONS, AND SCOPE

Accordingly the reader will see that with the use of signal splitting and variable gain as well as the novel use of the variable input impedance, the variable output impedances, and a novel new DC power balancing and distribution circuit, I have provided a unique arrangement of electronic elements in a new audio interface device which provides greatly improved performance than has been previously obtainable, simultaneously including all the following advantages:

- Higher audio signal quality than yet obtained in an audio interface device designed for connecting instrument-level to pro-audio level signal processing devices. Having better tonal, noise and distortion specifications.
- Continuously variable input impedance, resulting in improved signal preservation or the ability to be creative about intentionally mismatching impedances.
- Continuously variable output impedance resulting in improved signal preservation or the ability to be creative about intentionally mismatching impedances.
- Novel DC power balancing circuit that cancels power related noise that typically affects high quality audio circuits resulting in greatly improved noise and distortion specifications as compared others.

Although the above description contains many specifications, these should not be construed as limitations to the scope of the invention, but as illustrations of a presently preferred embodiment of this invention. For example, the bidirectional, variable-impedance instrument-level to professional-level audio interface with signal splitters and balanced DC power device would also be beneficial for use as an amplifier splitter since all of the instrument-level outputs can be simultaneously connected to multiple amplifiers. Also, the balanced DC power supply can be used not only within but also beyond the field of professional audio electronics wherever an electronic device would benefit from the noise canceling advantage of balanced DC power.

Also, the unique arrangement of electronic elements comprising the bidirectional, variable-impedance instrument-level to professional-level audio interface with signal splitters and balanced DC power device is not limited to the specific arrangement stated in the preferred embodiments. Substituting different transistors, diodes, capacitors, resistors, materials or substances to tailor the circuit for specific applications would not necessarily be considered a new invention. Some examples could be changes to affect the variable range of input impedance or output impedance, changes to affect the variable range of gain controls, changes to the number of splits to provided fewer or more outputs, changes to affect distortion, changes to affect noise or substituting the preferred parts with more or less expensive parts. Furthermore, the individual sub-circuits might be divided into individual products; or combined and incorporated with other devices (such as incorporating the balanced DC power circuit within an audio mixing console).

Thus the scope of the invention should be determined by the appended claims and their legal equivalents, rather than by the examples given.

The invention claimed is:

1. A bidirectional instrument-level to professional-level audio interface with signal splitters and balanced DC power, comprising:

- a first circuit having an instrument-level input, signal splitter, and a professional-level audio output interface;
- a second circuit having a professional-level input and an instrument-level output interface;

a regulated floating power source made into balanced positive and negative output voltages with inherent AC noise cancellation in respect to a star ground reference point.

2. The device of claim 1, wherein said first circuit comprises a means to vary the input impedance of said instrument-level input.

3. The device of claim 2, wherein said first circuit comprises a means to provide a buffered output of said instrument-level input.

4. The device of claim 2, wherein said first circuit comprises a means to adjust the output gain of said instrument-level input.

5. The device of claim 4, wherein said first circuit has a means to vary the output impedance of said instrument-level input.

6. The device of claim 5, wherein said means to vary the output impedance has a signal indicator.

7. The device of claim 4, wherein said means to vary the input impedance has a signal indicator.

8. The device of claim 2, wherein said first circuit comprises a means to adjust the output gain of said professional-level audio output interface.

9. The device of claim 2, wherein said first circuit has a means to reverse the polarity of the output of said professional-level audio output.

10. The device of claim 1, wherein said second circuit comprises a means to adjust input level of said professional-level input to instrument-level interface.

11. The device of claim 1, wherein said second circuit has a means to reverse the input polarity.

12. The device of claim 1, wherein said second circuit has a signal indicator.

13. The device of claim 1, wherein said second circuit has a means to vary the output impedance of said instrument-level output interface.

14. A bidirectional instrument-level to professional-level audio interface with signal splitters and balanced DC power, comprising:

a first circuit having an instrument-level input, signal splitter, and a professional-level audio output interface;

a second circuit having a professional-level input and an instrument-level output interface;

a regulated floating power source providing current having a potential of V made into balanced first positive output voltage and second negative output voltage wherein the first output has a potential of +(V/2) and the second output has a potential of −(V/2) with respect to a common ground reference point and said first and second outputs are provided to said first and second circuits.

15. The device of claim 14 wherein the common ground reference point is connected to a first circuit ground reference point and a second circuit ground reference point.

* * * * *